US011176778B2

(12) United States Patent
DiCarlo

(10) Patent No.: US 11,176,778 B2
(45) Date of Patent: Nov. 16, 2021

(54) SLOT MACHINE SYSTEM WITH MULTIPLE PROGRESS INDICATING INDICIA

(71) Applicant: Fernando DiCarlo, Woodbridge (CA)

(72) Inventor: Fernando DiCarlo, Woodbridge (CA)

( * ) Notice: Subject to any disclaimer, the term of this patent is extended or adjusted under 35 U.S.C. 154(b) by 0 days.

(21) Appl. No.: 16/154,102

(22) Filed: Oct. 8, 2018

(65) Prior Publication Data

US 2020/0111316 A1 Apr. 9, 2020

(51) Int. Cl.
*G07F 17/34* (2006.01)
*G07F 17/32* (2006.01)

(52) U.S. Cl.
CPC ..... *G07F 17/3262* (2013.01); *G07F 17/323* (2013.01); *G07F 17/3209* (2013.01); *G07F 17/3258* (2013.01); *G07F 17/3213* (2013.01); *G07F 17/34* (2013.01)

(58) Field of Classification Search
CPC .. G07F 17/34; G07F 17/3262; G07F 17/3258; G07F 17/323; G07F 17/3209; G07F 17/3213
See application file for complete search history.

(56) References Cited

U.S. PATENT DOCUMENTS 5,664,998 A * 9/1997 Seelig ..... G07F 17/3211 273/143 R
5,823,872 A * 10/1998 Prather ..... A63F 3/00082 463/6
6,306,041 B1 * 10/2001 Mendes, Jr. ..... A63F 9/143 273/442
6,450,889 B1 * 9/2002 Mendes, Jr. ..... A63F 9/143 273/442
2002/0132658 A1 * 9/2002 Brown ..... G07F 17/3211 463/16
2003/0036430 A1 * 2/2003 Cannon ..... G07F 17/32 463/42
2005/0020340 A1 * 1/2005 Cannon ..... G07F 17/32 463/16
2011/0117996 A1 * 5/2011 Rommerdahl ..... G07F 17/32 463/20
2014/0045586 A1 * 2/2014 Allen ..... G07F 17/3288 463/25
2015/0228163 A1 * 8/2015 Clarebrough ..... G07F 17/3213 463/20

* cited by examiner

*Primary Examiner* — Steve Rowland
(74) *Attorney, Agent, or Firm* — Muskin and Farmer LLC

(57) ABSTRACT

An electronic system and method to implement a slot machine gaming system which simultaneously displays a plurality of progress indicating indicia. The player spins at least one reel and the based on the result of the spin one of the progress indicating indicia can advance to an advanced state. When all of the progress indicating indicia are advanced to their final state (position) then the player wins a jackpot.

18 Claims, 14 Drawing Sheets

SLOT MACHINE SYSTEM WITH MULTIPLE PROGRESS INDICATING INDICIA

BACKGROUND OF THE INVENTION

Field of the Invention

The present general inventive concept is directed to a method, apparatus, and computer readable storage medium directed to an entertainment system

Description of the Related Art

Electronic games are a huge industry in the United States and throughout the world. What is needed is a new casino game that will be profitable for the house and exciting and enjoyable for players.

SUMMARY OF THE INVENTION

It is an aspect of the present invention to provide an electronic interactive and entertaining game.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
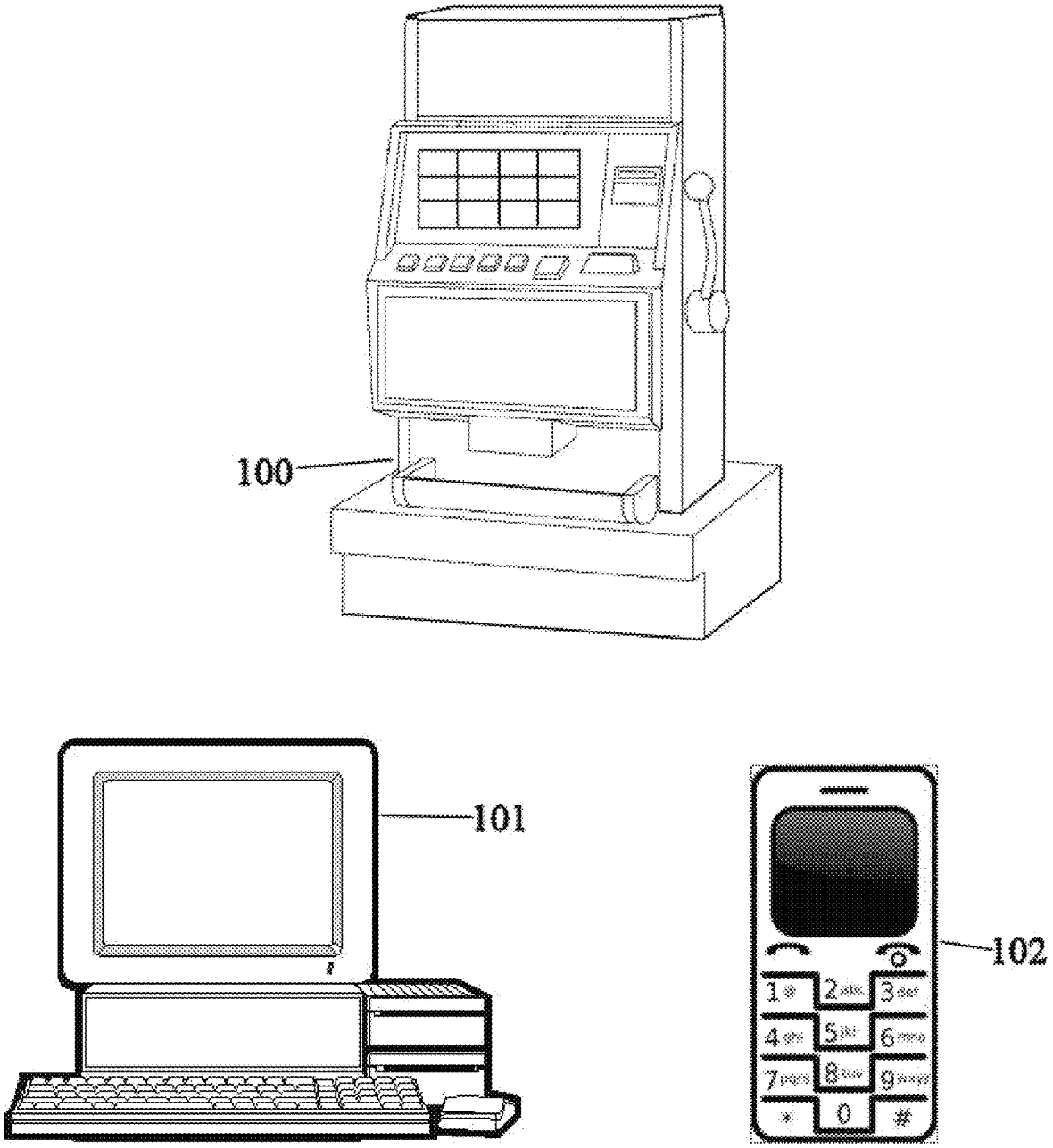
FIG. 1 is a drawing of different hardware that the methods herein can be played on, according to an embodiment.

Reference will now be made in detail to the presently preferred embodiments of the invention, examples of which are illustrated in the accompanying drawings, wherein like reference numerals refer to like elements throughout.

The present inventive concept relates to a method, apparatus, and computer readable storage medium to implement a slot machine type game which has multiple progress indicating indicia. A progress indicating indicia is an indicia depicting an object, collection of items, or anything that can indicate multiple states. For example, in one embodiment of the inventive concept there would be three progress indicating indicia displayed simultaneously and each progress indicating indicia can be depicted as a building. Each building can have four sections and five states (e.g., empty, first section filled in, first and second section filled in, first and second and third section filled in, and first and second and third and fourth sections filled in). In other words, each progress indicating indicia would display which of the five states it is in so that it can be easily discerned by the player. The goal of the player is to progress all of the progress indicating indicia to their completed (final) state. Depending on the embodiment, there can be other numbers of states than five (e.g., 2 to 10) and other numbers of progress indicating indicia (e.g., 2 to 10).

The goal of the player is to convert all of the progress indicating indicia into their completed state. Once this happens, the game is over and the player wins a jackpot (which can be a fixed or progressive jackpot). The player would advance each progress indicating indicia by spinning a one reel slot machine (although in other embodiments different numbers of reels can be used such as 2-5 reels), and a final symbol (when the reel stops spinning) that appears on the reel would indicate which (if any) of the progress indicating indicia would advance to a next state. There is also an "end game" symbol that can appear on the reel which would end the game and all of the progress indicating indicia would be reset back to there initial states.

During the game, the player can receive offers in credits to end the game in exchange for the offered amounts of credits. The player can choose to accept the offer and the credits offered end the game (with the credits being added to their credit meter), or decline the offer and continue playing (the player hoping to win the jackpot).

FIG. 1 is a drawing of different hardware that the methods herein can be played on, according to an embodiment.

The game described herein can be played by players on a typical electronic gaming machine (e.g., slot machine), a personal computer (or laptop) 101, or a cell (mobile) phone 102. Each of these devices would be connected to a network which would be connected to a server 500. The connection can be via a physical LAN, wireless connection (e.g., WIFI, Bluetooth, etc.) simple cables, etc.

Figure 2:
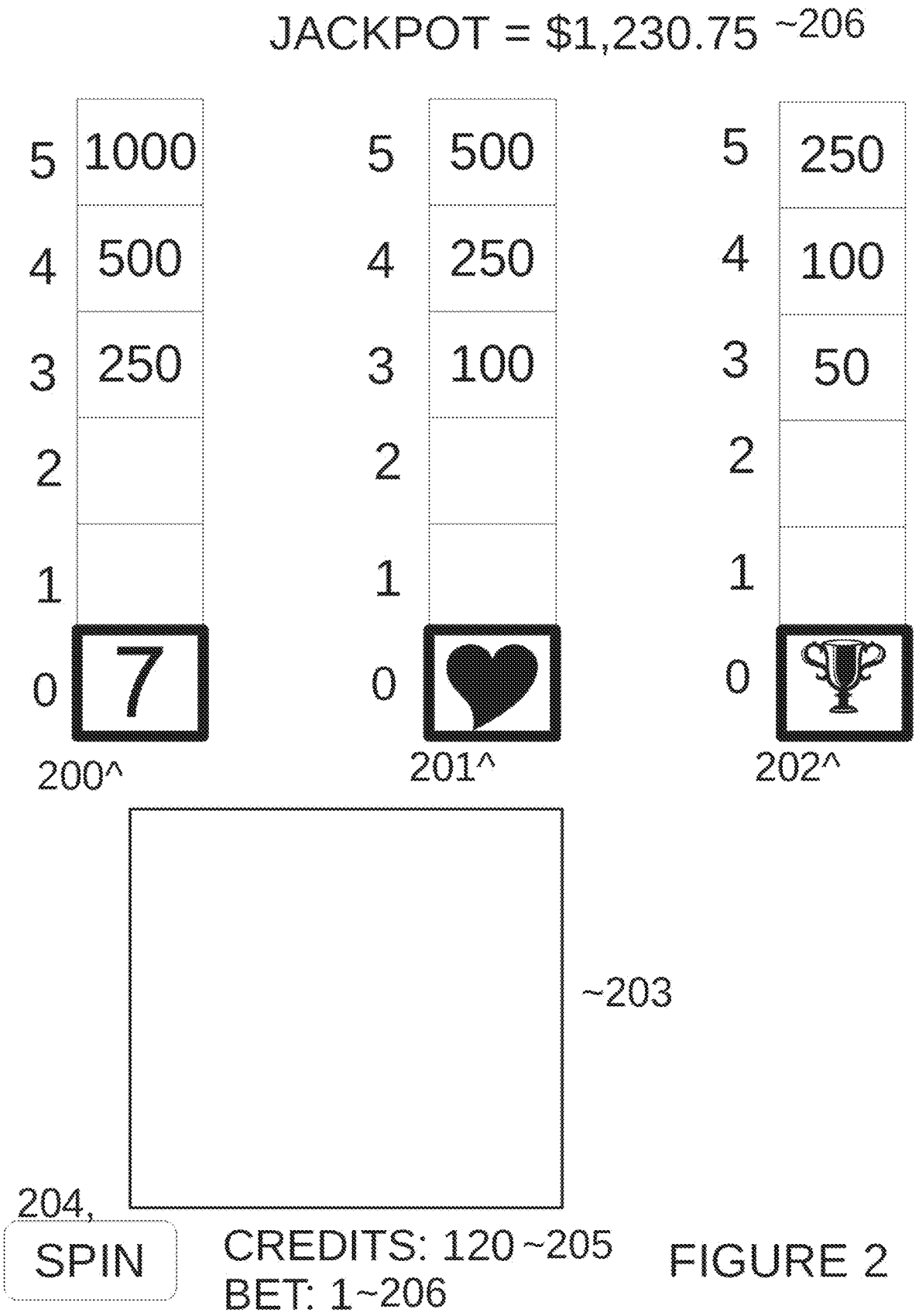
FIG. 2 is a drawing illustrating a starting of a game sequence in an initial position, according to an embodiment.

FIG. 2 is a drawing illustrating a starting of a game sequence in an initial position, according to an embodiment.

Illustrated are three progress indicating indicia, a 7 progress indicating indicia 200, a heart progress indicating indicia 201, and a trophy progress indicating indicia 202.

Each progress indicating indicia has 6 states being numbered from 0 to 5, with 0 being the initial position and 5 being the final (desirable from the point of the player) position. A slot machine reel 203 can also be spun upon the press of a spin button 204. A credit meter 205 indicates how many credits the player currently possesses, and a bet meter 206 indicates how many credits are bet (bet amount) on the game/next spin. A jackpot meter 206 is used to indicate the current amount of the jackpot (if the player can successfully convert all three progress indicating indicia to their completed state).

Note that the bet amount should remain constant during the same game sequence. In other words, the bet amount can be changes while the game is in the initial state (all progress indicating indicia are in their initial states/positions), but once one of the progress indicating indicia has advanced typically the bet would not be permitted to be changed until the game sequence has ended (the player has won the jackpot, the player has received and end game symbol, or the player has accepted an offer).

Before the player can start making wagers (and playing), the player must fund the machine with real money (e.g., cash). For example, the player can deposit cash (e.g., a $10 bill) in a bill acceptor connected to the machine which would credit the machine/account with $10 in credits (if credits are $1 per credit then this would translate to 10 credits). The machine/account can also be funded by other mechanisms as well, such as an electronic funds transfer, credit card payment, etc. "bet" and "wager" are used synonymously herein.

The player can spin the reel 203 by pressing the spin button 204. The bet amount 206 will be deducted from the credit meter 205 and the reel 203 will start spinning and stop on a random symbol (either a physical reel can be used or a virtual reel which is animated using computer animation). The random symbols the reel stops at (and any random determination needed by the game) can be determined by a random number generator (implemented in hardware or software).

Note that there are a plurality of progress indicating indicia and each one is associated with a symbol which corresponds to a symbol on the reel. Thus, when a symbol results (appears after a spin) on the reel that has a corresponding progress indicating indicia then that respective progress indicating indicia will advance (unless it is already advanced to the final position upon which it will remain in the final position). Note that in an embodiment it is also possible to have additional symbols on the reel (non-associated symbols) that do not have a corresponding progress indicating indicia (such as the blank symbol) although such a non-associated symbol (e.g., a cherry symbol) could award the player a credit amount (e.g., 2 credits) without advancing/affecting any of the progress indicating indicia (since that symbol has no corresponding progress indicating indicia).

The reel can have a plurality of reel stops, each reel stop with a symbol. Table I represents one example of the reel map.

TABLE I

| Position | symbol |
|---|---|
| 1 | seven |
| 2 | heart |
| 3 | trophy |
| 4 | blank |
| 5 | oops! |

Note that in one embodiment, all reel stops can have an equal probability of being landed on during a spin. In another embodiment, each reel stop can be weighted so that some reel stops (symbols) have a higher probability of being landed on than others. For example, seven can have a 10% probability of resulting (being landed on when the reel stops spinning), heart can have a 20% probability of resulting, trophy can have a 25% probability of resulting, blank can have a 25% probability of resulting, and oops can have a 20% probability of resulting. Of course, these probabilities are merely examples and other probabilities can be utilized as well (of course the game's overall return to player (RTP) should be in an acceptable range (e.g., 90 to 99%). In a further embodiment, a reel structure is not really necessary and the symbol(s) displayed when a spin stops is a randomly determined symbol (with optional weighted probabilities.)

Note that each symbol has its own operation. A progress indicating indicia symbol (seven, heart, trophy) advances the respective progress indicating indicia by one (unless the respective progress indicating indicia is already at its final state in which no further advancement is made). The blank symbol does not advance any of the progress indicating indicia (does nothing) but it did cost the player the bet amount. An end game symbol ends the game for the player without providing the player any award. Ending the game means resetting all of the progress indicating indicia back to their initial positions (the '0' position). Of course, the player does not want to get the end game symbol (which is the worst symbol to get) because it ends the game without an award to the player (and cost the player a bet). The player also prefers not to get the blank symbol because the player has wasted a bet. The player prefers to get one of the progress indicating indicia symbols so the player can advance in the game. There should be at least one progress indicating indicia symbol on the reel for each progress indicating indicia displayed in the game.

In another embodiment, instead of using one reel stop for each symbol as illustrated in Table I, a reel can have many reel stops. Table II illustrated a reel mapping with a reel that has 24 positions. Note that throughout this document (and figures), the word "seven" refers to the '7' symbol illustrated in the figures, the word "heart" refers to the 'heart' symbol used in the figures, and the word "trophy" refers to the 'trophy' symbol used in the figures. The symbols can be replaced with any other symbol and the ones used are merely examples. The end game symbol used 'oops' of course can be replaced with any other such symbol (typically with a negative connotation).

TABLE II

| Position | symbol |
|---|---|
| 1 | seven |
| 2 | blank |
| 3 | heart |
| 4 | blank |
| 5 | trophy |
| 6 | blank |
| 7 | blank |
| 8 | oops |
| 9 | blank |
| 10 | trophy |
| 11 | blank |
| 12 | blank |
| 13 | oops |
| 14 | trophy |
| 15 | blank |
| 16 | oops |
| 17 | heart |

TABLE II-continued

| Position | symbol |
|---|---|
| 18 | blank |
| 19 | oops |
| 20 | oops |
| 21 | blank |
| 22 | heart |
| 23 | blank |
| 24 | trophy |

Of course, the reel mapping illustrated in Table II is merely an example, and other reel mappings (and numbers of stops) can be used as well. Each reel stop can have an equal probably of being landed on, or each reel stop can still be weighted to adjust the probability of being landed (so that not each reel stop has an equal probability of being landed on).

An example of a game sequence will now be presented. Note that FIGS. 2-9 all happen in sequence. Then after FIG. 9, depending on the player's action, FIG. 10 would result after FIG. 9 or FIGS. 11-12 would result after FIG. 9. Of course, this is merely one example of a game sequence and the game can progress in any manner in accordance with the game player (see FIG. 13).

Figure 3:
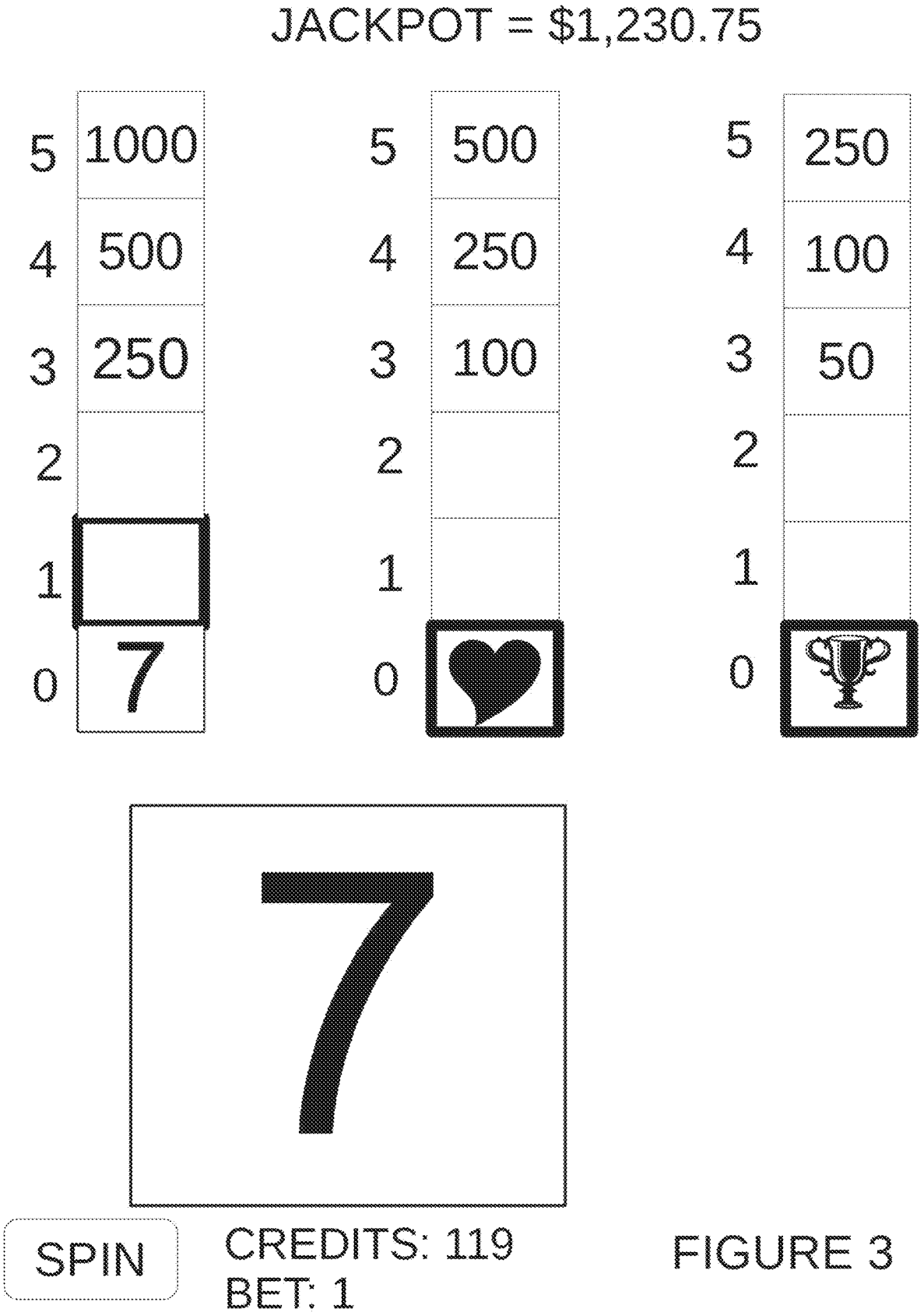
FIG. 3 is a drawing illustrating advancing in the game sequence, according to an embodiment.

FIG. 3 is a drawing illustrating advancing in the game sequence, according to an embodiment.

The player his pressed the spin button from FIG. 2, and now in FIG. 3 the bet amount (one credit) is deducted from the credit meter, the reel spins, and stops on the symbol 7. As such, the 7 progress indicating indicia is advanced by one. Note that the bolded section has moved from position 0 (the initial/default position) to position 1. This is a positive development for the player, as the player's goal is to advance all three of the progress indicating indicia to their final positions/states (position 5) which would result in the player winning the jackpot.

Note that each progress indicating indicia is displayed is a tower or track with a bolded/highlighted section moving vertically up as it progresses to the next state. This is just one example and it can be appreciated that the progress indicating indicia can be represented in numerous other ways as well. For example, the progress indicating indicia can be represented by any of the following: a number indicating the state (e.g., 0, 1, 3, 4, 5); a collection of items (e.g., 0 bananas is position 0, 1 banana is position 1, 2 bananas is position 2, etc.), a building which lights up (e.g., a building with no lights is position 0, the building with the bottom section lit up is position 1, the building with a higher section lit up is position 2, etc. with the building fully lit up is position 5), a runner running down a field (one side is position 0, the running moves in a direction each increase in position until the runner reaches the other side of the field which is position 5). Thus, it does not matter how the position/state of each progress indicating indicia is displayed to the player, although players may prefer a more attractive and intuitive progress indicating indicia.

Figure 4:
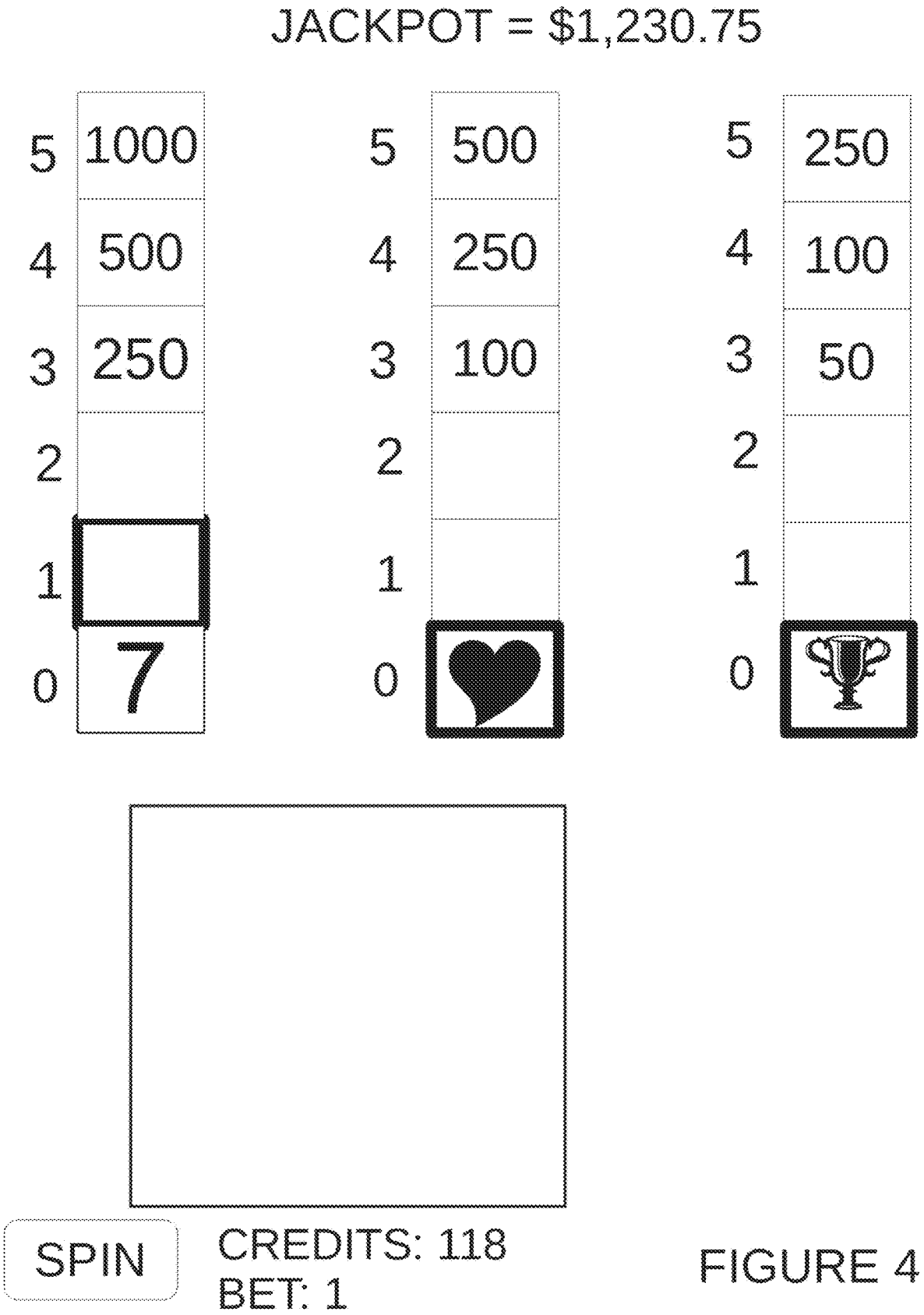
FIG. 4 is a drawing illustrating further play of the game sequence, according to an embodiment.

FIG. 4 is a drawing illustrating further play of the game sequence, according to an embodiment. The player presses the spin button in FIG. 3 to arrive at FIG. 4.

The resulting symbol (the symbol that the reel lands on) is a blank which does nothing. All of the states of the progress indicating indicia remain the same.

Figure 5:
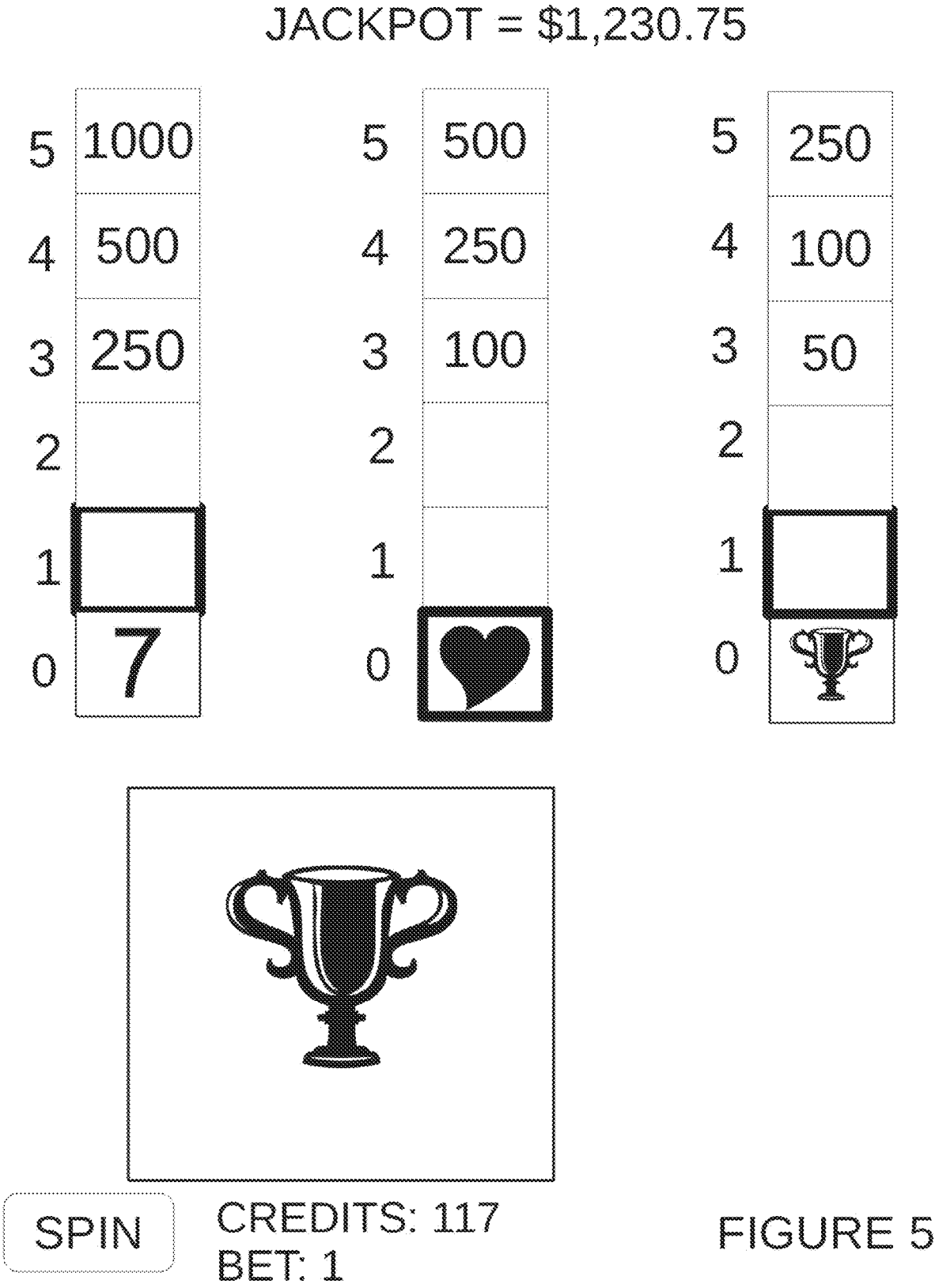
FIG. 5 is a drawing illustrating further advancing in the game sequence, according to an embodiment.

FIG. 5 is a drawing illustrating further advancing in the game sequence, according to an embodiment. The player presses the spin button in FIG. 4 to arrive at FIG. 5.

The resulting symbol is the trophy. Thus, the trophy progress indicating indicia is advanced one position to position 1. This is also positive (good) for the player as it increases the player's expectation (see below).

Figure 6:
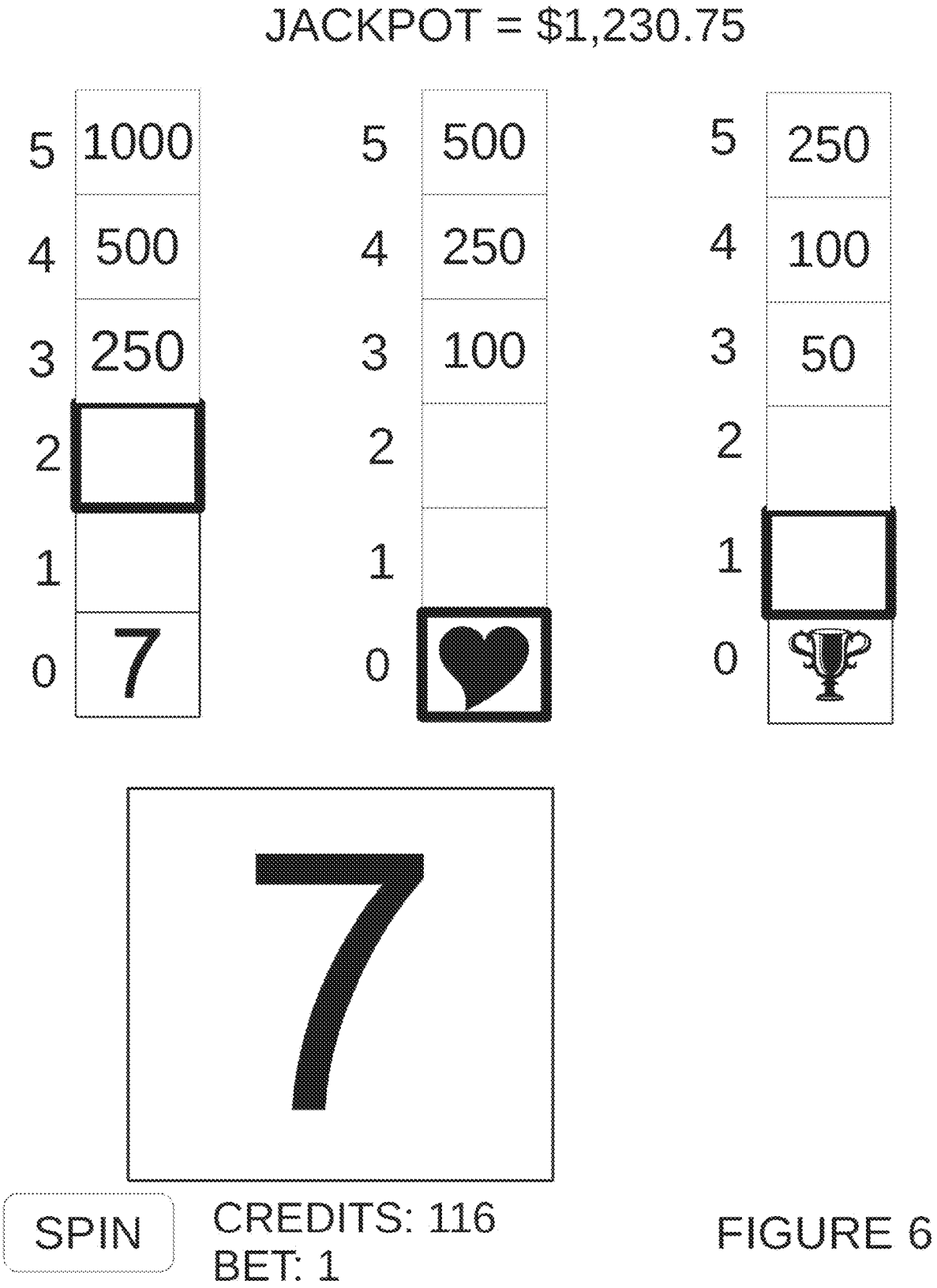
FIG. 6 is a drawing illustrating more advancing in the game sequence, according to an embodiment.

FIG. 6 is a drawing illustrating more advancing in the game sequence, according to an embodiment. The player presses the spin button in FIG. 5 to arrive at FIG. 6.

The resulting symbol is the 7 symbol. Thus the 7 progress indicating indicia advanced on position to position 2.

Figure 7:
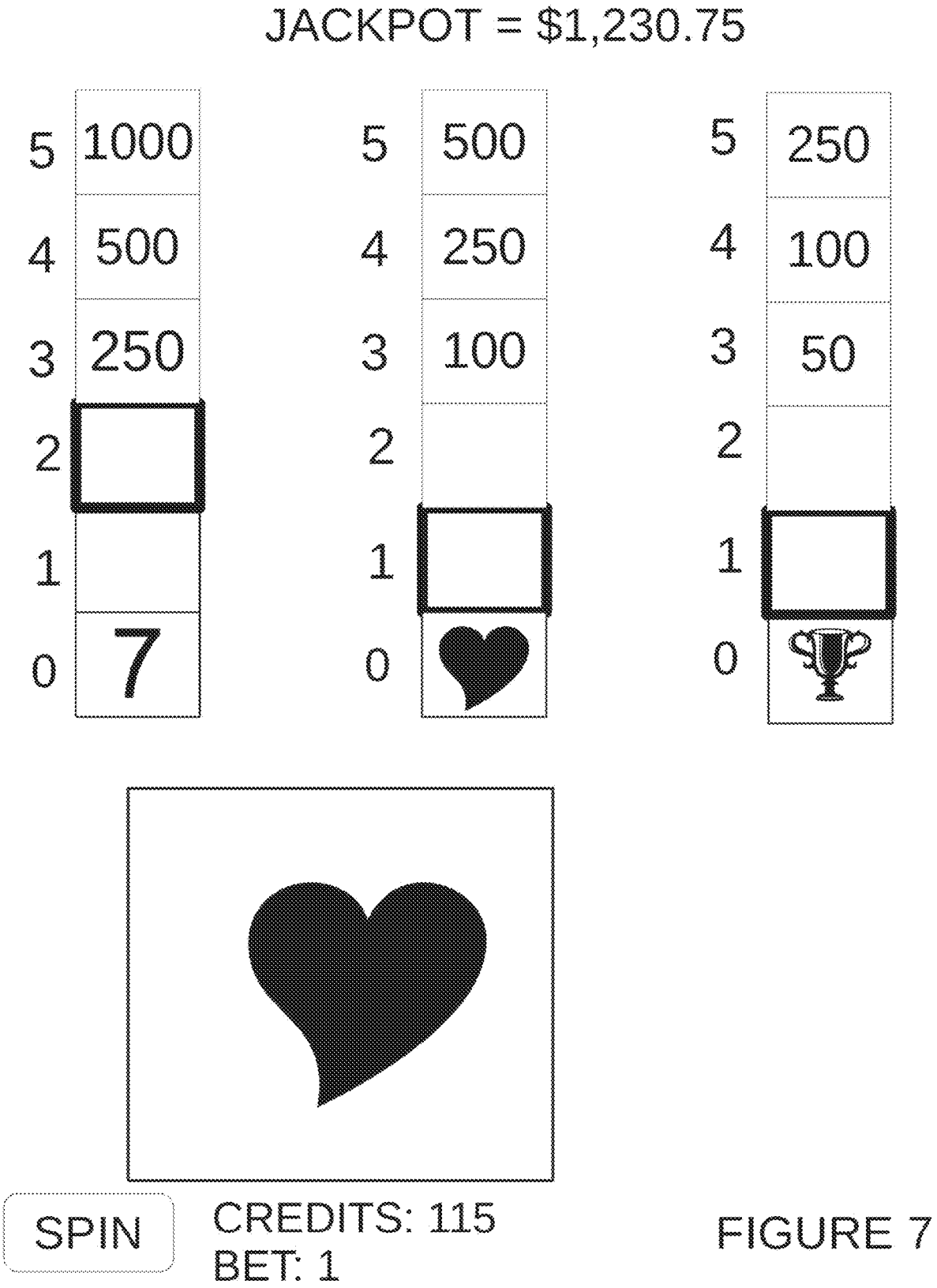
FIG. 7 is a drawing illustrating additional advancing in the game sequence, according to an embodiment.

FIG. 7 is a drawing illustrating additional advancing in the game sequence, according to an embodiment. The player presses the spin button in FIG. 6 to arrive at FIG. 7.

The resulting symbol is the heart symbol. Thus, the heart progress indicating indicia advances one position to position 1. As can be seen, the current position of each progress indicating indicia is evident by which section is highlighted/bolded. The current position can also be displayed as filled in as well.

Figure 8:
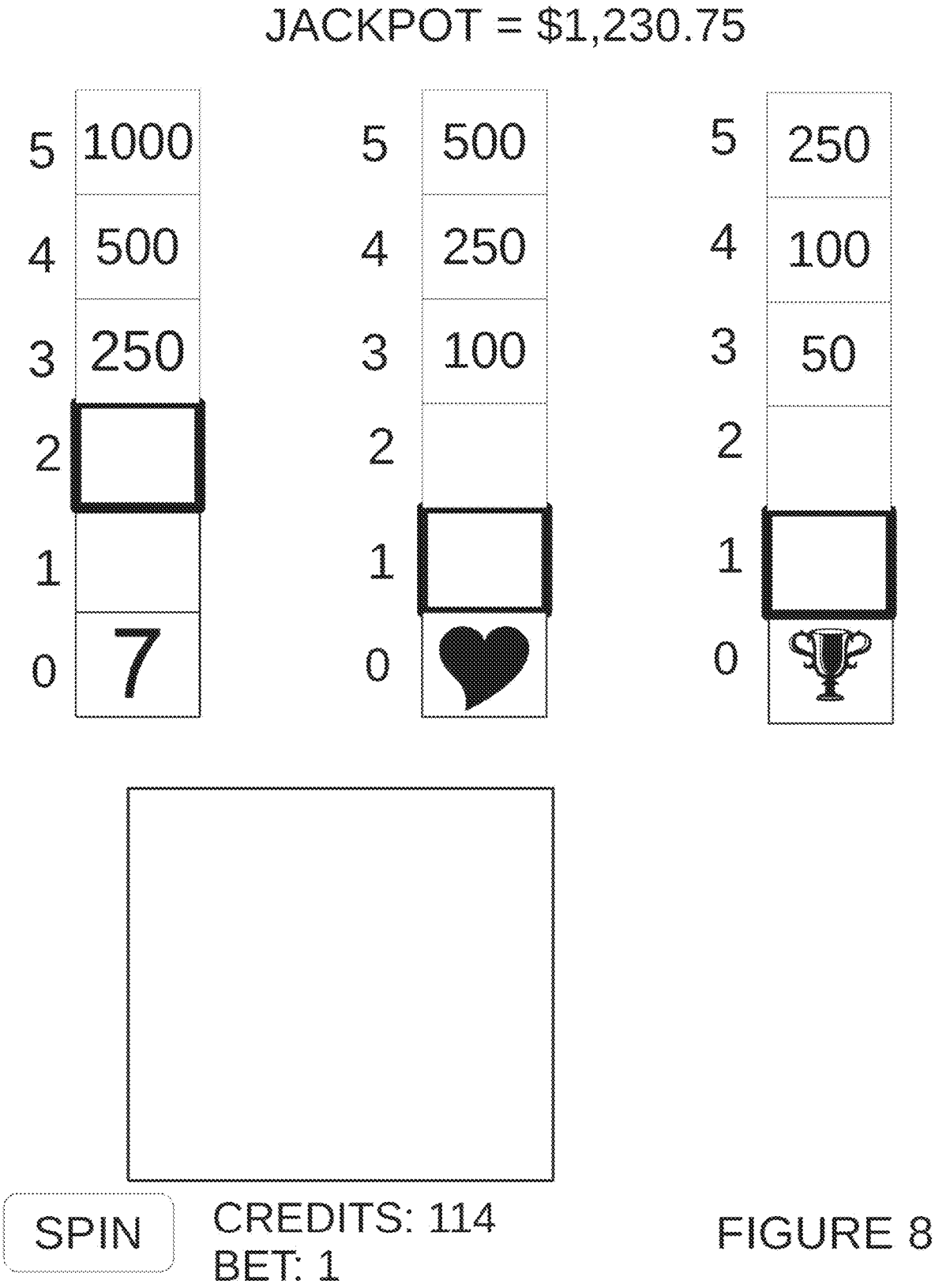
FIG. 8 is a drawing illustrating further play in the game sequence, according to an embodiment.

FIG. 8 is a drawing illustrating further play in the game sequence, according to an embodiment. The player presses the spin button in FIG. 7 to arrive at FIG. 8.

The resulting symbol is the blank symbol. Thus, the positions of the progress indicating indicia all remain the same.

Figure 9:
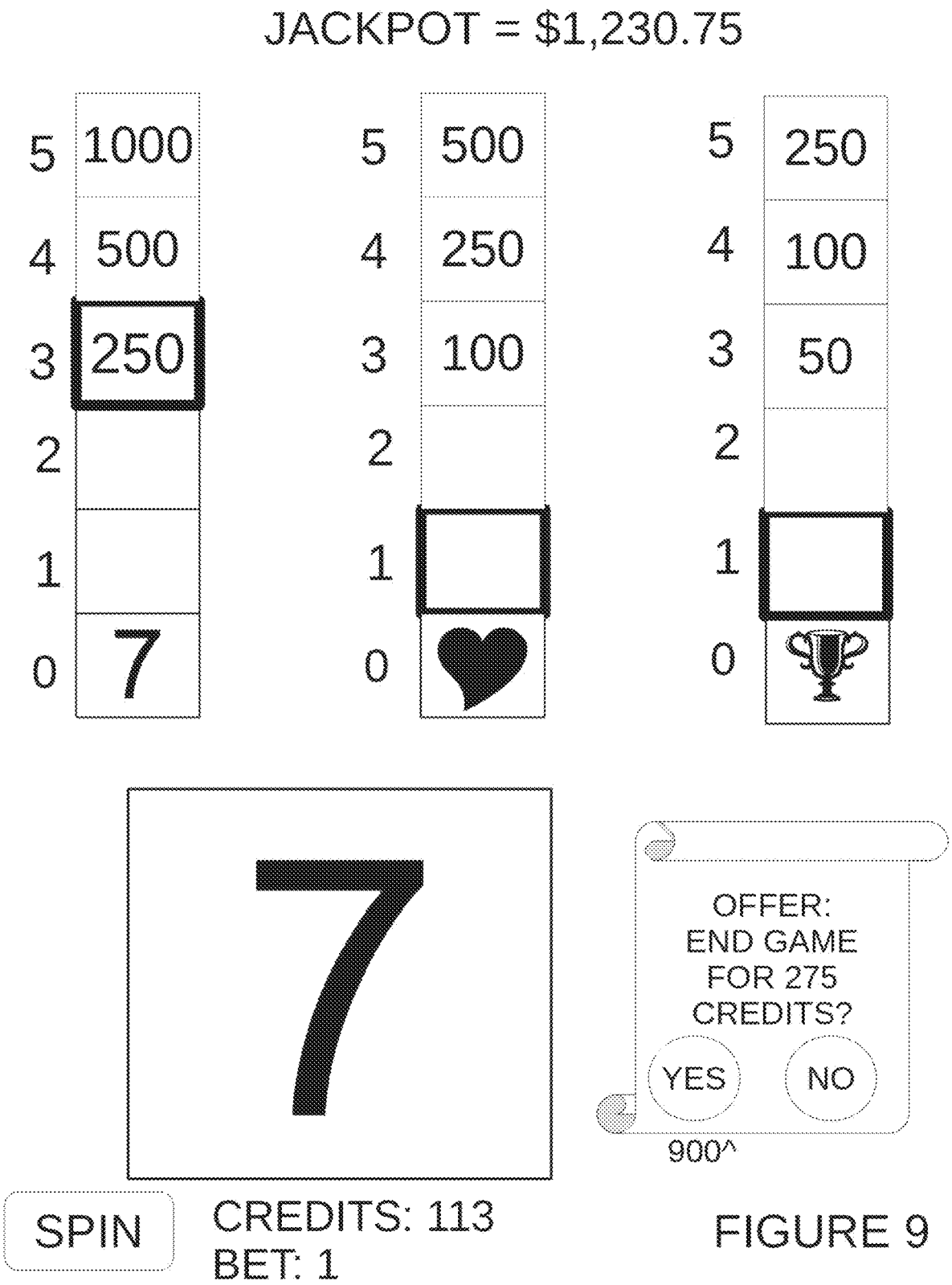
FIG. 9 is a drawing illustrating advancing in the game sequence and getting an offer, according to an embodiment.

FIG. 9 is a drawing illustrating advancing in the game sequence and getting an offer, according to an embodiment. The player presses the spin button in FIG. 8 to arrive at FIG. 9.

The resulting symbol is the 7 symbol. Now an offer 900 is made. The player is offered an amount (in this example 275) credits to end the game. The player can select (e.g., touch, click, press, etc.) the "yes" button to accept this offer or the "no" button to reject this offer. Some players may like the "sure thing" of the offer and accept it, while other players may be trying to go for the jackpot (which will be higher than all such offers) and wish to keep playing.

Figure 10:
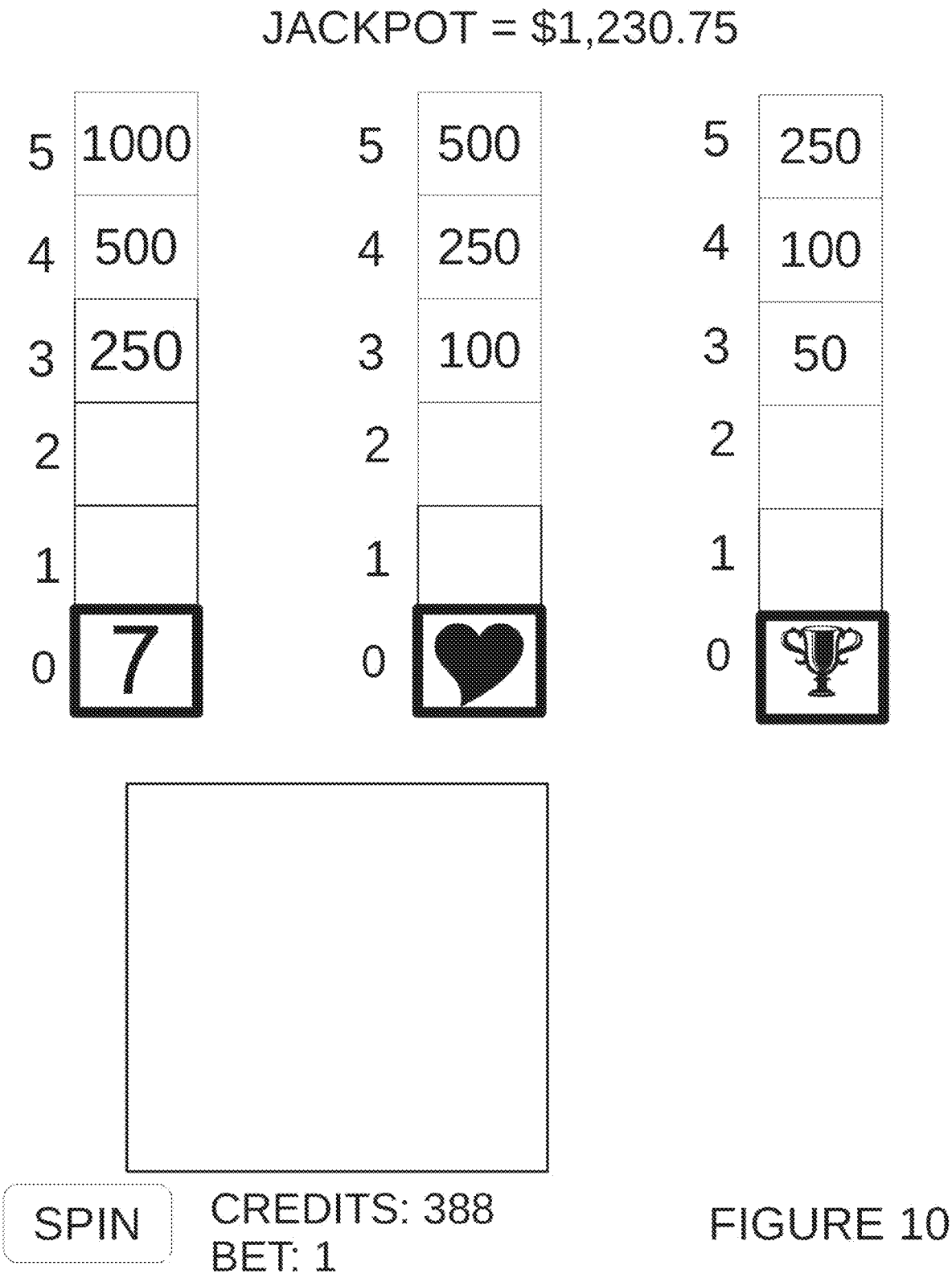
FIG. 10 is a drawing illustrating accepting the offer in FIG. 9, according to an embodiment.

FIG. 10 is a drawing illustrating accepting the offer in FIG. 9, according to an embodiment. The player has selected the "yes" button in FIG. 9 to arrive at FIG. 10.

The credit meter is increased by the offer amount (275 credits). The game has now ended with all progress indicating indicia being reset back to their initial positions (0 positions). The player can now begin a new game sequence if the player wishes. Since all progress indicating indicia are in their initial position, the player can (in an embodiment) adjust the bet amount (e.g., bet 2 credits each spin instead of one which would provide the player higher awards than betting only 1 credit each spin).

Figure 11:
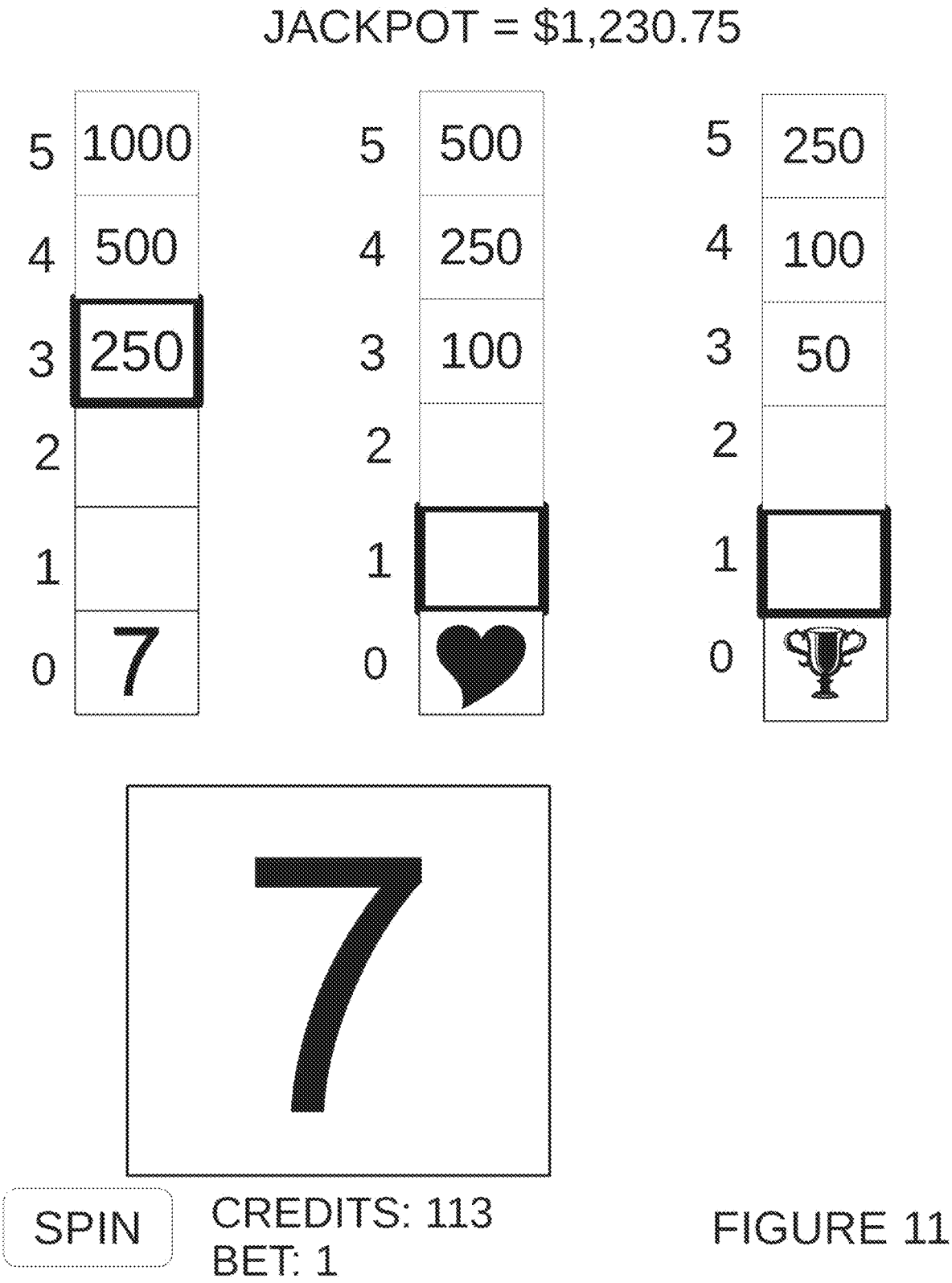
FIG. 11 is a drawing illustrating declining the offer in FIG. 9, according to an embodiment.

FIG. 11 is a drawing illustrating declining the offer in FIG. 9, according to an embodiment. The player has selected the "no" button in FIG. 9 to arrive at FIG. 10.

The game sequence continues. Since the player has rejected the offer, the number of credits remains the same as when the offer was rejected.

Figure 12:
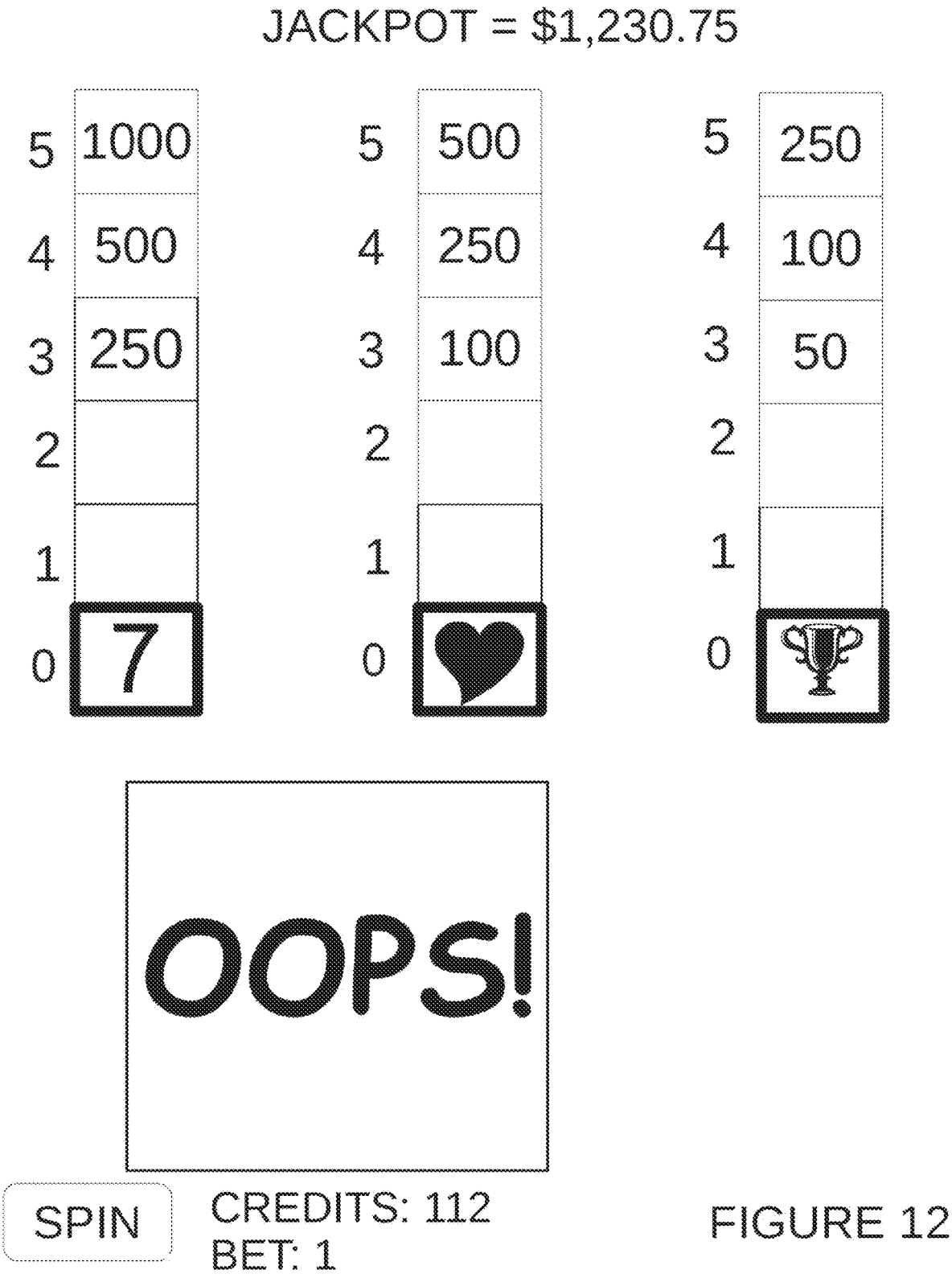
FIG. 12 is a drawing illustrating continuing play from FIG. 11 and getting an end game symbol, according to an embodiment.

FIG. 12 is a drawing illustrating continuing play from FIG. 11 and getting an end game symbol, according to an embodiment. The player presses the spin button in FIG. 11 to arrive at FIG. 12.

The resulting symbol is the 'oops!' symbol (which is an end game symbol). The game now ends with no award being made to the player. All of the positions of the progress indicating indicia are reset to position 0. The player can now begin a new game sequence if the player wishes. Since all progress indicating indicia are in their initial position, the player can (in an embodiment) adjust the bet amount (e.g., bet 2 credits each spin instead of one which would provide the player higher awards than betting only 1 credit each spin).

Figure 13:
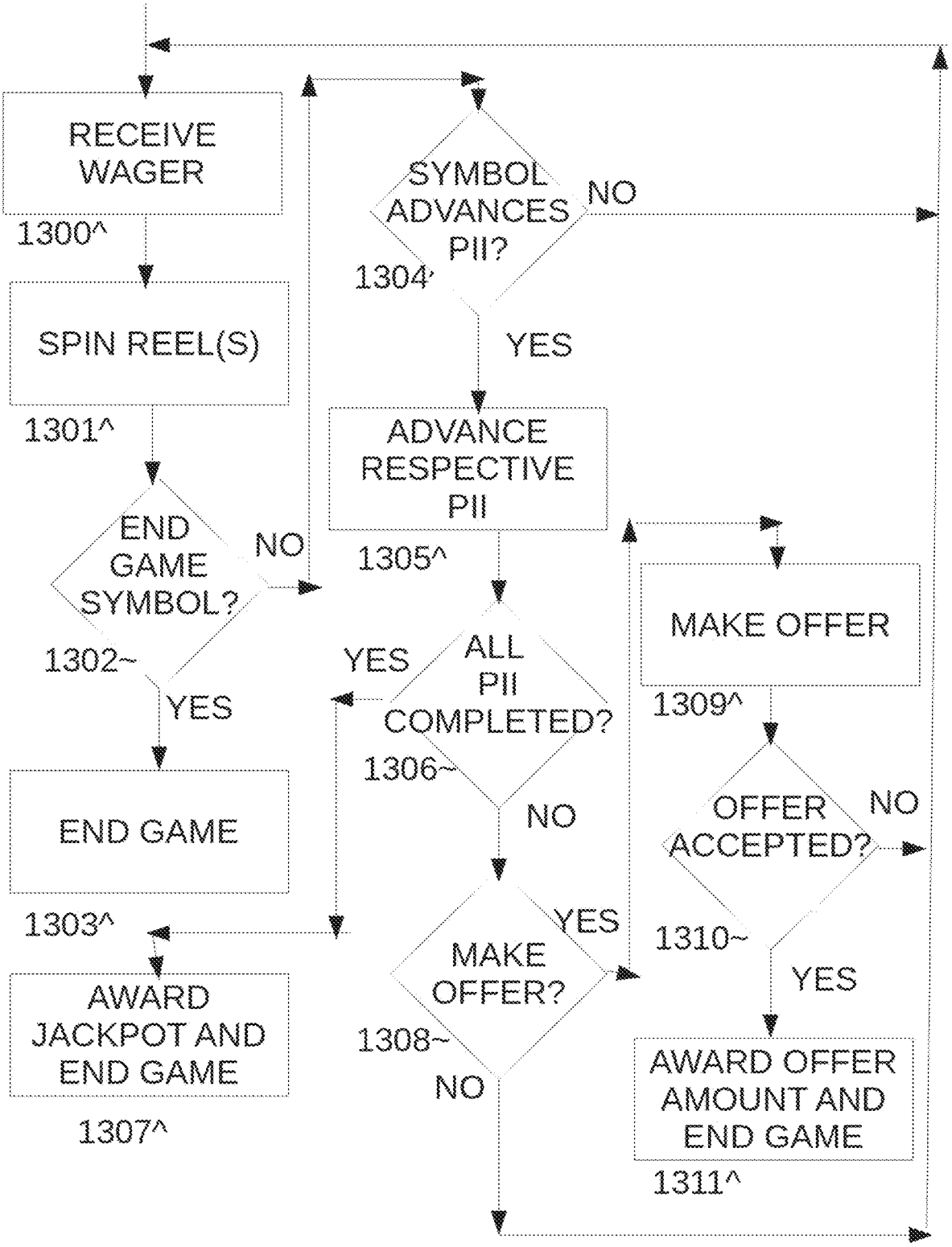
FIG. 13 is a flowchart illustrating an exemplary method of implementing a game sequence, according to an embodiment.

FIG. 13 is a flowchart illustrating an exemplary method of implementing a game sequence, according to an embodiment.

Before operation 1300, the player should fund the game by depositing cash or a cashless voucher (ticket), paying by credit card or other electronic payment, or other funding mechanism, which converts cash (or other quantity) into credits which are displayed on the credit meter. The credit meter displays at all times the number of credits the player currently has. The number of credits can always be cashed out and converted to cash at any time (by receiving a cashless voucher, cash payment, electronic funds transfer, etc.)

A game sequence is a series of games the player plays from an initial position (with all progress indicating indicia in their initial position (zero) until the game sequence is over (the player hit the jackpot, accepted an offer, and gotten an end game symbol). Typically, the player starts with all progress indicating indicia in their initial (zero) position. Before the first game in the game sequence, the player can choose the wager amount (e.g., 1 credit, 2 credit) which the player must wager on each spin in the sequence. The greater the bet size, the higher the expected wins can be (but of course the game would still have the overall mathematical house edge in the long run).

In operation 1300, a wager is received. This is done by deducting the bet amount from the credit meter. If the player is out of credits, the player would have to deposit additional funds (convertible into credits) in order to continue playing. Typically, the player would press the spin button for the wager to be received and to progress to operation 1301.

From operation 1300, the method proceeds to operation 1301, which spins the reel(s). Described herein is a one reel game, although it can be appreciated that the game can be implemented with other numbers of reels (2 through 5 or more). In a multi-reel game, each progress indicating indicia can be advanced in a number of possible ways: a single reel can contain the progress indicating indicia symbols which would cause the respective progress indicating indicia to advance; particular predefined combinations on a paytable would cause respective progress indicating indicia symbols to advance (for example three 7's on a payline would cause the 7 progress indicating indicia to advance), etc. In addition to symbols causing the progress indicating indicia to advance, a game can also have award paying combinations which cause the game to pay an award to the player (e.g., 10 credits or any other amount) independent of the progress indicating indicia.

From operation 1301, the method proceeds to operation 1302, which determines whether the spin from operation 1301 resulted in an (the) end game symbol. If so, the method proceeds to operation 1303. If not, then the method proceeds to operation 1304. Note that in a multi-reel embodiment, instead of an end game symbol, there can be an end game combination of one or more symbols which if it appears on a payline would cause the method to proceed to operation 1303 and end the game.

In operation 1303, the game ends. The player is typically not paid a payout upon reaching 1303. All of the progress indicating indicia are reset back to their initial positions (zero) positions and a new game sequence can begin. Because all of the progress indicating indicia are reset to their initial positions, the player can optionally adjust the bet amount. Once any of the progress indicating indicia have advanced from their initial position, then typically the player would not be able to adjust the bet amount. The method can return to operation 1300 and a new game sequence can begin.

If in operation 1302, and end game symbol is not the result of the last spin (in operation 1301), or in a multi-reel embodiment the last spin did not result in a combination which ends the game, then the method proceeds to operation 1304, which advances a respective progress indicating indicia (PII). Some symbols in the one reel embodiment each correspond to a respective progress indicating indicia. In the multi-reel embodiment, some combinations would advance a corresponding progress indicating indicia associated with that combination. If the resulting spin (in operation 1301) does not result in advancing a progress indicating indicia, then the method returns to operation 1300 in which the player can make another bet.

In operation 1304, if it is determined that the spin from operation 1301 results in a progress indicating indicia advancing, then the method proceeds to operation 1305 which advances the respective progress indicating indicia corresponding to the result of the spin in operation 1301. In the single reel embodiment, if the last spin results in a single symbol which corresponds to a progress indicating indicia, then that respective progress indicating indicia would be advanced. In the multi-reel embodiment, if the combination of symbols from the last spin (on a payline) corresponds to a progress indicating indicia, then that respective progress indicating indicia would be advanced (for example, three trophies could be defined on the paytable to advance the trophy progress indicating indicia). The advancing of the progress indicating indicia would be accomplished by visually indicated on the respective progress indicating indicia the advancement using computer generated graphics (e.g., lighting up another section of a building, displaying an additional symbol, highlighting a marker, displaying a number, etc.) Of course, the computer implementing the game would store all of the current states of the progress indicating indicia. The progress indicating indicia would only advance (e.g., move up in the examples illustrated in FIGS. 2-12) or remain in the same position during a turn (spin) but would not reverse (go in the reverse direction opposite to the advancing direction which would be down in FIGS. 2-12).

From operation 1305, the method proceeds to operation 1306, which determines whether all of the progress indicating indicia (PII) are completed (have reached their final position). For example, the progress indicating indicia in the Figures herein all have five positions with the fifth position being the final (completed) position which is the most desirable for the player. If all of the progress indicating indicia have reached their final state then the method proceeds to operation 1307. If all of the progress indicating indicia have not reached their final state, then the method proceeds to operation 1308.

In operation 1307, all of the progress indicating indicia have reached their final positions and hence the player wins a jackpot. In the Figures shown herein, all of the three progress indicating indicia would be highlighted on position 5. The jackpot is what is displayed on the jackpot meter 206. The jackpot typically is the highest award (payout) that can possibly be won in the game. Typically, it is very difficult and unlikely to win the jackpot, but it is mathematically possible. In order to reach the jackpot, the player would have had to decline all offers (since accepting an offer ends the game). The jackpot amount is either a fixed (predetermined) amount, or a progressive amount which changes (increases) over time with a small portion of each bet contributing towards the progressive amount (which if hit, would reset to a default amount). Once the jackpot is awarded, the player can begin a new game sequence by returning to operation 1300 (and the player can optionally have the option to change the bet size has well).

If in operation 1306, all of the progress indicating indicia have not been completed, then the method proceeds to operation 1308 which determines whether the game will make the player an offer or not. An offer is where the game would present the player with an amount in credits and the player has the option to receive that credit amount and end the game (take of accept the offer) or decline the offer and keep playing. Not all spins would result in an offer being made. However, there are some criteria that would define at which times an offer would be made to the player. For example, in an embodiment, anytime at least one of the progress indicating indicia is beyond a certain position (e.g., past position 2) then an offer would be made. In this example, as long as any of the progress indicating indicia was at least in position 3 then an offer would always be made. In another embodiment, an offer would be made based on a random determination (e.g., 25% of the time operation 1308 is implemented would result in an offer being made). In another embodiment, an offer could be made every N spins (where N is a positive number greater than 1, for example N can be 3 thus every 3 spins the player is presented with an offer). In another embodiment, an offer could be made to the player when the player's expectation in the game is at least (or greater than) a predetermined amount. The expectation is a mathematical determine as to how much the player would be expected to win based on the current positions of all of the progress indicating indicia. So for example, if the expectation is greater than 100 credits (or any other amount of credits such as 10 to 10,000 or more) an offer would be made. However, typically, an offer would not be made if all of the progress indicating indicia are still in the initial positions (position 0) as in this situation the player would not have a positive expectation greater than the bet amount.

If in operation 1308, it is determined (by the computer implementing the game) not to make an offer to the player, then the method returns to operation 1300 in which the player can place another bet (of the same amount as all of the previous spins in this game sequence) and spin the reels (operation 1301).

If in operation 1308, the computer implementing the game determines to make an offer, then the method proceeds to operation 1309 wherein an offer is made (see offer 900 in FIG. 9).

In operation 1309, an offer amount is first determined based on the expectation. The more advanced the progress indicating indicia are, the higher the expectation would be. In an embodiment, the expectation can be computed by running a simulation (a large number of automatically run games which can be a "Monte Carlo" simulation) for each of the possible combinations of the progress indicating indicia to determine the probability of winning the jackpot (operation 1307) with no offers being accepted. The probability of winning the jackpot multiplied by the jackpot amount results in the expectation. The offer amount can be a predetermined (or random) percentage of the expectation. For example, the offer amount can be 75% of the expectation, so if the expectation (considering the current positions of the progress indicating indicia) is 100 credits then the offer amount would be 75 credits. Note that credits are directly redeemable for a cash amount, for example, 1 credit can equal 1 dollar ($1).

The game can maintain a table to determine the offer amounts. Since in the example used here, there are three progress indicating indicia and each has five positions, then this means there are 5^3=125 overall possible states of the game. A table can store offer amounts for each of these 125 possible states. Thus, the offer amount can be determined simply by retrieving a respective value from the table. The offer amount can optionally also be slightly adjusted (e.g., reduced by a random number from 1 to 5) so that the same offer amounts aren't repeated frequently to the player.

Note that the amounts inside the positions in FIGS. 2-12 are minimum offer amounts (minimum offers). For example, in the 7 progress indicating indicia, the 5 (final) position has a 1000 in it meaning that if the 7 progress indicating indicia is in the fifth (5) position then any offer the player gets would be at least 1,000 credits, There is a 500 in the fourth position of the 7 progress indicating indicia, meaning if the 7 progress indicating indicia is in the fourth (4) position then any offer the player gets would be at least 500 credits. Note that in FIG. 9 the 7 progress indicating indicia is in the third (3) position, meaning that any offer the player gets would be at least 250 credits. Note that the heart progress indicating indicia has 100 in the third position, meaning that if the heart progress indicating indicia was in the third position then any offer the player gets would be at least 100 credits. The same is true for all of the other minimum offer amounts shown (500 in the fifth position for the heart progress indicating indicia, 250 for the fourth position for the heart progress indicating indicia, 250 for the fifth position for the trophy progress indicating indicia, 100 for the fourth position for the trophy indicating indicia, and 50 for the third position for the trophy progress indicating indicia). If two or more progress indicating indicia are highlighted with minimum offer amounts, then any offer the player would receive would have to be at least the higher of the highlighted minimum offer amounts. In FIG. 9, since the third position of the 7-progress indicating indicia is highlighted, the offer presented 900 must be at least 250 credits. In one embodiment, the minimum offers remain constant throughout the game. In another embodiment, the minimum offers can be dynamic (change) throughout the game. For example, as a progress indicating indicia advances position, the expectation will increase and hence any subsequent offer would increase. As such, in the dynamic minimum offer embodiment, after a progress indicating indicia advances then all (or some) of the displayed minimum offers will increase in response to the advancement. The minimum offers give the player an idea of how much an offer (if they get one) will at least be, providing further enjoyment and excitement for the player.

Once the offer amount is determined, the offer is displayed to the player along with an accept button (e.g., "yes") and a decline button (e.g., "no"), see FIG. 9, offer 900. If the player declines the offer (e.g., by selecting the "no" button), then the method returns to operation 1300 wherein the player continues to bet and spin.

If in operation 1310, the player accepts the offer (e.g., by selecting the "yes" button), then the method proceeds to operation 1311. In operation 1311, the offer amount (from operation 1309) is awarded to the player (by adding the amount of credits in the offer amount to the amount in the credit meter). So for example, if the player had 10 credits in the credit meter, and the offer amount that was accepted was 20 credits, the player will now have 30 credits in the credit meter and the game ends. The game sequence is now over and the method can return to operation 1300 wherein the player can begin a new game sequence with all of the progress indicating indicia reset back to their initial position (zero). Since the game sequence is over, and all of the progress indicating indicia are rest back to their initial position, the player can optionally change the bet amount.

Figure 14:
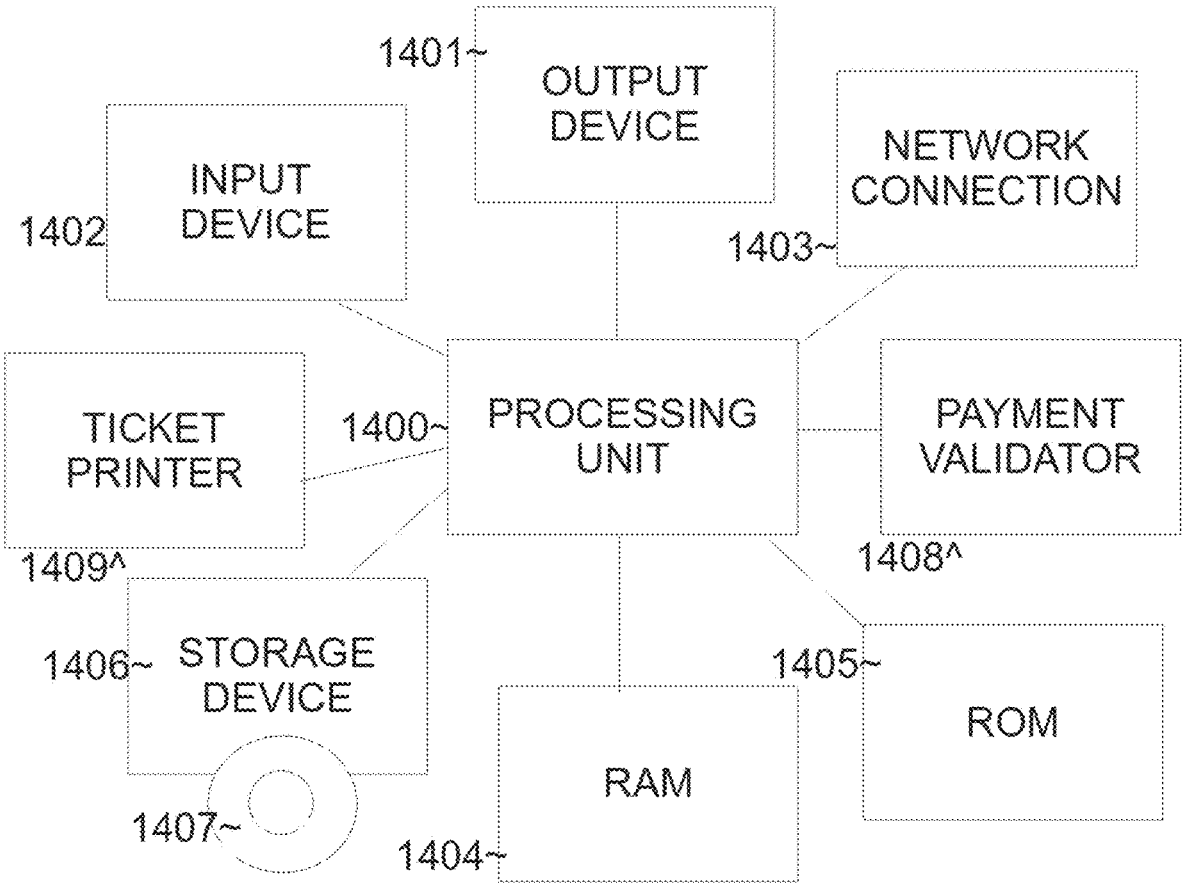
FIG. 14 is a block diagram illustrating exemplary hardware that can be used to implement an electronic version of the methods described herein.

FIG. 14 is a block diagram illustrating exemplary hardware that can be used to implement the game described herein, according to an embodiment. The hardware in FIG. 14 can be used to implement a computer implementing the game described herein and/or a server that is serving the game to a computer which is displaying the game to a player. Such a server can interface with a social networking site (e.g., FACEBOOK, MYSPACE, etc.) that is used to coordinate the entire game and communicate with the players as well as a server used by the social network site. The hardware can also be, for example, an electronic gaming machine (EGM) used in casinos such as a video slot machine. The hardware can also be a personal computer or personal computing device (e.g., laptop, desktop, cell phone, tablet, etc.) playing the game using the Internet. The hardware can also be any other type of device, working individually or in conjunction with other devices.

A processing unit 1400 (such as a microprocessor and any associated components) is connected to an output device 1401 (such as an LCD monitor, touch screen, CRT, etc.) which is used to display to the player any aspect/output/state of the method, and an input device 1402 (e.g., buttons, a touch screen, a keyboard, mouse, etc.) which can be used to input from the player any decision/input made by the player. All methods described herein can be performed by the processing unit 1400 by loading and executing respective instructions which are programmed accordingly. Multiple such processing units can also work in collaboration with each other (in a same or different physical location). The processing unit 1400 can also be connected to a network connection 1403, which can connect the electronic gaming device to a computer communications network such as the Internet, a LAN, WAN, etc. The processing unit 1400 is also connected to a RAM 1404 and a ROM 1405. The processing unit 1600 is also connected to a storage device 1606 which can be a disk drive, DVD-drive, CD-ROM drive, flash memory, etc. A non-transitory computer readable storage medium 1407 (e.g., hard disk, CD-ROM, etc.), can store a program which can control the electronic device to perform any of the methods described herein and can be read by the storage device 1406 and written to by the storage device 1406.

The processing unit 1400 can also be connected to a payment validator 1408. The payment validator can be a bill acceptor which accepts currency, identifies it as being valid (typically by using an optical scanner), and then credits the inserted bill amount to the machine (for example inserting a $10 bill will credit the machine with $10 in credits). These credits can be used to play the games (e.g., pay for a spin). The bill acceptor can also accept cashless tickets as part of a 'ticket-in-ticket-out" system, in which tickets (cashless vouchers) have cash value and can be inserted into the payment validator 1608. The validator 1408 validates the ticket (typically be optically scanning a bar-code), communicating electronically with a casino database to verify the ticket is authentic, and once authenticated then crediting the machine with the respective amount of credits. The payment validator 1408 can also include a card reader which can read cards (e.g., with a magnetic stripe or other electronic encoding) so that an account number can be accessed. The cards can be a credit card, player loyalty card, specific casino payment card, or any card that can provide electronic access to a monetary amount owned by the player (owner of the card) which the player can utilize for depositing money and then playing the machine. If such a card is used, then the player can optionally enter (using a keypad) an amount the player wishes to withdraw from the account associated with the card to credit to the machine. The player can also the card in this matter to request that the machine electronically transfer any credits on the machine (e.g., credits) to the player's account associated with the card.

The processing unit 1400 can also be connected to a ticket printer 1409 which can print tickets (cashless vouchers). When the player cashes out on the machine (indicated to the machine that the player wishes to cash out and terminate by, typically by pressing a button), a ticket is printed by the ticket printer 1409 which carries (can be redeemed for) the amount of credits left on the machine in the credit meter. This ticket can then be used to play other machines in the casino by inserting them into that machine's payment validator. The ticket can also be used to redeem for cash by inserting it into a ticket redemption machine (kiosk) which receives a ticket, validates it (typically by scanning the barcode), and then dispenses an identical amount of cash to what the ticket's value is. Note that at any time during play, the player can cash out (typically by pressing a cash out button) all of the credits shown in the credit meter into numerous forms which are cash or can be redeemed by cash by the player, such as cash, coins, a cashless ticket, an electronic payment, crypto-currency, etc.

While one processing unit is shown, it can be appreciated that one or more such processor (processing units) can work together (either in a same physical location or in different locations) to combine to implement any of the methods described herein. Programs and/or data required to implement any of the methods/features described herein can all be stored on any non-transitory computer readable storage medium (volatile or non-volatile, such as CD-ROM, RAM, ROM, EPROM, microprocessor cache, etc.)

Note that if the embodiments described herein are implemented as an electronic gaming machine (EGM) then it may be necessary for the machine to be approved by the regulatory authorities (e.g., the Nevada State Gaming Commission) to ensure they have a suitable return to player (RTP) and are honest. Such approval includes inspection of the hardware, software, play-testing, evaluation of the random number generators (either hardware or software), etc. Once the machine has been approved from a rigorous testing will it be officially approved by a regulatory authority and then can appear in that jurisdiction's gaming floor.

Figure 15:
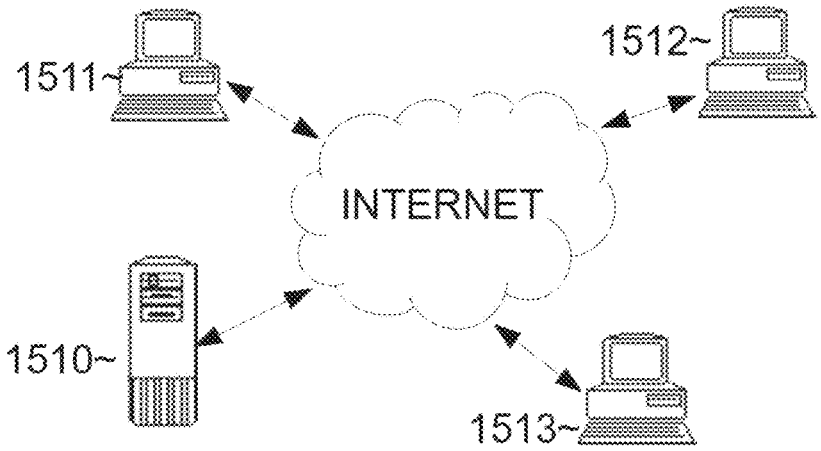
FIG. 15 is a block diagram illustrating an exemplary network configuration to implement a player playing an online version of the methods described herein.

FIG. 15 is a network diagram showing a network structure for an online casino and players, according to an embodiment.

A computer communications network (such as the Internet) can be used to connect an online casino server 1510 which can host and serve an online casino and implement a game as described herein via the internet. Note that while FIG. 15 shows only one online casino server 1710, the casino server 1510 can encompass numerous servers all cooperating with each other (whether in the same physical location or not). The casino server 1510 communicates with players 1511, 1512, 1513 through the Internet (or other computer communication network) and can remotely implement any of the methods/games described herein by executing computer code programmed accordingly. As such, the methods/games described herein can be offered at an online casino for credits which are exchangeable for real money.

All components herein can be distributed across different such components as needed. For example, a single server as mentioned herein can be distributed across numerous different servers and locations. A processor (or processing unit)

can also be distributed across multiple processors in a same or different computer (at a same or different location). The electronic components described herein represent an abstraction but it can be appreciated that the computer systems implementing the methods herein can be more numerous and interconnected than illustrated herein.

If a player is playing the game described herein on a social networking site or other type of hosted environment, then the player's computer would cooperate with the social networking server in order to present the game to the player. The player's computer would perform the instructions necessary to display the game while the remote server can determine the results (e.g., the final arrangement) and communicate this result via the Internet to the player's computer so that the player's computer can accurately display the result. The remote server may track and account for all credits wagered and won/lost while the player's computer can display the amount of credits owned or won at the direction of the remote server so the player cannot tamper with these amounts. All games described herein are considered to be played on the site described herein.

Any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer. All variations and features described herein can be combined with any other features described herein without limitation.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An apparatus to implement a wagering game, the apparatus comprising:

an electronic output device and an electronic input device;

an electronic storage device configured to read a non-transitory computer readable storage medium which stores computer readable instructions;

at least one processing unit connected to the electronic output device, the electronic input device, and the electronic storage device, the at least one processing unit configured to utilize the electronic storage device to read and execute the computer readable instructions which are programmed to cause the at least one processing unit to:

display a plurality of progress indicating indicia, each progress indicating indicia having a plurality of different states;

implement an individual game, the individual game comprising:

receive a wager and spin at least one reel to a result;

based on the result, determine whether to advance a respective one of the progress indicating indicia and if so then advance the respective one of the progress indicating indicia;

determine whether all of the plurality of progress indicating indicia are in their final positions and if so then awarding a jackpot;

determine whether the result contains an end game symbol or end game combination and if so then then reset all of the plurality of progress indicating indicia back to their initial positions; and enable a player to continue to repeat plays of the individual game, make an offer to the player of an offer amount, wherein if the offer is rejected by the player then the wagering game continues and if the offer is accepted by the player then the offer amount is awarded to the player and the plurality of progress indicating indicia are all reset back to their initial positions.

2. The apparatus as recited in claim 1, wherein the computer readable instructions are further programmed to display a plurality of minimum offer amounts, each of the plurality of minimum offer amounts associated with a respective position of a respective progress indicating indicia.

3. The apparatus as recited in claim 1, wherein the computer readable instructions are further programmed such that the offer amount is determined based upon an expectation based on positions of all of the progress indicating indicia.

4. The apparatus as recited in claim 1, wherein the computer readable instructions are further programmed such that at least one reel comprises exactly one reel.

5. The apparatus as recited in claim 4, wherein the computer readable instructions are further programmed such that the one reel comprises a symbol corresponding to each of the plurality of progress indicating indicia.

6. The apparatus as recited in claim 5, wherein the computer readable instructions are further programmed such the one reel comprises a non-associated symbol which does not correspond to each of the plurality of progress indicating indicia and when the non-associated symbol is the result then none of the plurality of progress indicating indicia advance.

7. The apparatus as recited in claim 6, wherein the computer readable instructions are further programmed such that the non-associated symbol is a blank symbol.

8. The apparatus as recited in claim 6, wherein the computer readable instructions are further programmed such that the one reel comprises the end game symbol.

9. The apparatus as recited in claim 1, wherein the computer readable instructions are further programmed such that plurality of progress indicating indicia comprise exactly three progress indicating indicia.

10. A method to implement a wagering game, the method comprising:

providing an electronic output device and an electronic input device;

providing an electronic storage device configured to read a non-transitory computer readable storage medium which stores computer readable instructions;

providing at least one processing unit connected to the electronic output device, the electronic input device, and the electronic storage device;

executing the computer readable instructions by the at least one processing unit which cause the at least one processing unit to perform:

displaying a plurality of progress indicating indicia, each progress indicating indicia having a plurality of different states;

providing an individual game which comprises all of the operations of: receiving a wager and spin at least one reel to a result; using the result to determine whether to advance a respective one of the progress indicating indicia and if so then advance the respective one of the progress indicating indicia; determining whether all of the plurality of progress indicating indicia are in their final positions and if so then awarding a jackpot; determining whether the result contains an end game symbol or end game combination and if so then then resetting all of the plurality of progress indicating indicia back to their initial positions;

implementing the individual game; and making an offer to the player of an offer amount and implementing offer rules comprising if the offer is rejected by the player then the wagering game continues and if the offer is accepted by the player then the offer amount is awarded to the player and the plurality of progress indicating indicia are all reset back to their initial positions.

11. The method as recited in claim 10, further comprising displaying a plurality of minimum offer amounts, each of the plurality of minimum offer amounts associated with a respective position of a respective progress indicating indicia.

12. The method as recited in claim 10, wherein the offer amount is determined based upon an expectation based on positions of all of the progress indicating indicia.

13. The method as recited in claim 10, wherein the at least one reel comprises exactly one reel.

14. The method as recited in claim 13, wherein the one reel comprises a symbol corresponding to each of the plurality of progress indicating indicia.

15. The method as recited in claim 14, wherein the one reel comprises a non-associated symbol which does not correspond to each of the plurality of progress indicating indicia and when the non-associated symbol is the result then none of the plurality of progress indicating indicia advance.

16. The method as recited in claim 15, wherein the non-associated symbol is a blank symbol.

17. The method as recited in claim 15, wherein the one reel comprises the end game symbol.

18. The method as recited in claim 10, wherein the plurality of progress indicating indicia comprise exactly three progress indicating indicia.

* * * * *